US005364325A

United States Patent [19]

Matthews

[11] Patent Number: 5,364,325

[45] Date of Patent: Nov. 15, 1994

[54] LEVERAGED WEIGHT COMPOUNDING SYSTEM

[76] Inventor: Douglas R. Matthews, 50 E. Wyoming St., St. Paul, Minn. 55107

[21] Appl. No.: 79,988

[22] Filed: Jun. 18, 1993

[51] Int. Cl.[5] ..... A63B 21/008

[52] U.S. Cl. ..... 482/111; 482/109; 482/93

[58] Field of Search ..... 482/106, 108, 109, 111, 482/110, 112, 105, 93

[56] References Cited

U.S. PATENT DOCUMENTS

| | | | |
|---|---|---|---|
| 3,006,646 | 10/1961 | Nanni | 482/109 |
| 3,658,326 | 4/1972 | Fawick . | |
| 3,756,592 | 9/1973 | Johnson . | |
| 4,290,599 | 9/1981 | Berger . | |
| 4,378,113 | 3/1983 | Piccini . | |
| 4,505,474 | 3/1985 | Mattox . | |
| 4,659,078 | 4/1987 | Blome . | |
| 4,986,535 | 1/1991 | Hull et al. | 482/112 |
| 5,076,570 | 12/1991 | Davis . | |
| 5,244,445 | 9/1993 | Amesquita | 482/109 |

FOREIGN PATENT DOCUMENTS 855312 2/1958 United Kingdom .

*Primary Examiner*—Richard J. Apley
*Assistant Examiner*—Lynne A. Reichard
*Attorney, Agent, or Firm*—Palmatier, Sjoquist & Helget

[57] ABSTRACT

The present invention relates to an exercise/physical therapy device incorporating the use of a leveraged weight compounding system cell. The invention includes a cell tube enclosing a plurality of weighted spheres within a Federal Drug Administration approved silicon based dimethyl siloxane polymer. The FDA approved silicon based dimethyl siloxane polymer liquid functions to provide resistance in order to decrease the speed of motion for the plurality of weighted spheres within the cell tube. The plurality of weighted spheres freely move within the cell tube upon the elevation of one of the ends of the invention by an individual during exercise or therapy. The invention provides an individual with an infinite variety of available exercises for strengthening muscles. The invention also permits an individual to select from an infinite variety of leveraged weights, dependent upon the position of grasping of the invention by an individual. The individual may therefore easily select an incremental change in leveraged weight, and required level of exertion, by simply repositioning the individual's hands upon the cell tube.

16 Claims, 1 Drawing Sheet

LEVERAGED WEIGHT COMPOUNDING SYSTEM

BACKGROUND OF THE INVENTION

Many individuals are injured requiring physical therapy in order to rehabilitate the muscles in the upper body, specifically the shoulders, elbows, and wrists. Typically, individuals exercise their arms, shoulders, and/or wrists in order to maintain tone and strength. An individual engaging in physical therapy activities usually incorporates exercise and motion elements in order to rehabilitate an injured area to the pre-injury range of motion and strength. Physical therapy activities therefore incorporate both stretching and motion procedures in order to increase range of motion and strength to atrophied muscles.

Physical therapists frequently require an individual to perform various exercises by using standard weights. An individual using standard weights frequently encounters a situation where the optimal resistance for exercise includes a weight between two of the standard weights available within a set. No known exercise and/or therapy equipment exists which uses a leveraged weight compounding system which may be easily adjusted by an individual to suit the individual's particular needs. In addition, no variable system of weights is known which provides to an individual a wide range of possible weight combinations for exercise.

SUMMARY OF THE INVENTION

The present invention relates to an exercise/physical therapy device incorporating the use of a leveraged weight compounding system cell. The invention includes a cell tube enclosing a plurality of weighted spheres within a Federal Drug Administration approved silicon based dimethyl siloxane polymer. The FDA approved silicon based dimethyl siloxane polymer liquid functions to provide resistance in order to decrease the speed of motion for the plurality of weighted spheres within the cell tube. The plurality of weighted spheres freely move within the cell tube upon the elevation of one of the ends of the invention by an individual during exercise or therapy. The invention provides an individual with an infinite variety of available exercises for strengthening muscles. The invention also permits an individual to select from an infinite variety of leveraged weights, dependent upon the position of grasping of the invention by an individual. The individual may therefore easily select an incremental change in leveraged weight, and required level of exertion, by simply repositioning the individual's hands upon the cell tube.

It is a principle object of the present invention to provide a new and improved exercise/physical therapy device of relatively simple and inexpensive design, construction, and operation which is safe and durable and which fulfills the intended purpose of functioning as a leveraged weight compounding system without fear of injury to persons and/or damage to property.

It is another object of the present invention to provide an individual with an exercise device which may be easily adjusted to render a desired level of weight for use during exercise.

It is still another object of the present invention to provide an individual with an exercise device having an active leveraged system which continuously varies the level of exertion required during exercise.

It is still another object of the present invention to provide to an individual the ability to use a single device for exercise at a desired exertion level as opposed to requiring the individual to use a particular weight which is a member of the fixed and standard class of weights which may cause over-exertion and/or strain.

It is still another object of the present invention to increase and/or improve the enjoyment level of individuals participating in exercise and/or physical therapy activities.

It is still another object of the present invention to provide a new and improved exercise device which is capable of providing overall body toning when used in a consistent exercise routine.

A feature of the present invention includes a cell tube for grasping by an individual during exercise and/or physical therapy activities.

Another feature of the present invention includes a plurality of weighted spheres disposed within the interior of the cell tube which provide the leveraged and variable weight during exercise and/or physical therapy activities.

Still another feature of the present invention includes a fluid-buffering means selected from an FDA approved silicon based dimethyl siloxane polymer liquid where the fluid-buffering means is located within the interior of the cell tube providing resistance to the movement of the weighted spheres, thereby increasing the duration of the exposure to an individual of leveraged weight during exercise.

Still another feature of the present invention includes a means for sealing the ends of the cell tube which confines the fluid-buffering means and the weighted spheres within the interior of the invention.

Still another feature of the present invention includes at least one tubular grip affixed to the exterior of the cell tube for grasping by an individual during exercise and/or physical therapy activities.

DETAILED SPECIFICATION OF THE PREFERRED EMBODIMENT

Figure 1:
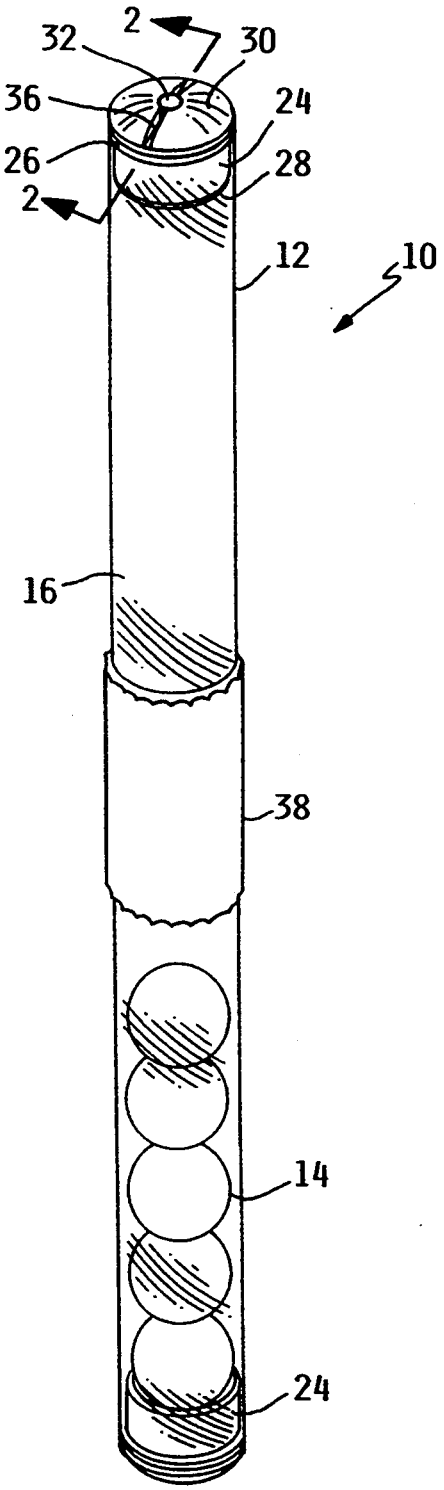
FIG. 1 is an isometric view of the invention.

One form of the invention is illustrated and described herein. The leveraged weight compounding system device is indicated in general by the numeral 10. The leveraged weight compounding system device 10 in general includes a cell tube 12, a plurality of weighted spheres 14, fluid-buffering means 16, a means for sealing the cell tube 18, and at least one grip 38.

The cell tube 12 is generally cylindrical in shape and is formed of one-piece construction of extruded clear polycarbonate material. Alternatively, the cell tube 12 may be formed of any clear polymer or plastic material, or opaque metallic material, at the preference of a manufacturer provided that the essential functions, features, and attributes described herein are not sacrificed. It should be noted that the cell tube 12 may be artistically colored or marked to satisfy the aesthetic requirements of different end user groups. The cell tube 12 may additionally be extruded of any colored polycarbonate material at the preference of a manufacturer.

The cell tube 12 in general may include an interior surface, an exterior surface, two ends, and an interior channel 22 milled into, and encircling, the interior surface proximal to each of the two ends. The interior surface and the exterior surface of the cell tube 12 are preferably free from all nicks, digs, and scratches providing a smooth surface for the engagement to the plurality of weighted spheres 14 internally, and providing a smooth comfortable exterior surface for grasping by a user. It is anticipated that the channels 22 may be required as a portion of the leveraged weight compounding system 10 during use in high impact applications such as simulated batting practice, halt swing use, or vigorous sports training applications. It should also be noted that use of the channels 22 is not required during normal physical therapy and muscle toning activities.

The cell tube 12 preferably has a first inside diameter approximating 1,625±0.025 inches. The corresponding exterior diameter approximates 1.750±0.025 inches providing the cell tube with a wall thickness approximating 0.062 inches. The cell tube 12 is preferably of sufficient strength and durability to not crack, fracture, break, split and/or leak during the use of the leveraged weight compounding system device 10. The cell tube 12 is preferably of sufficient strength to confine the plurality of weighted spheres 14, fluid-buffering means 16, and means for sealing the cell tube 18 without fracture, breakage, splitting or failure during exercise and/or physical therapy activities. The cell tube 12 preferably has an approximate ultimate tensile strength of between 9,000 and 11,000 pounds per square inch as tested by ASTM Test D638; an approximate tensile yield strength of between 7,000 and 9,000 pounds per square inch as tested by ASTM Test D638; and an approximate flexural strength of between 12,000 and 12,700 pounds per square inch as tested by ASTM Test D790. The cell tube 12 is further preferably abrasion resistant and has a hardness rating on the Rockwell Hardness Scale of approximately M73–78, Scale R112-125. The cell tube 12 further allows transmission of 88%–90% for passage of light. The above described properties provide an inherent balance of strength, clarity, abrasion resistance, a self-extinguishing nature, and Federal Drug Administration acceptance of the materials for the cell tube 12. The above described properties for the cell tube 12 additionally provide inherent durability during use of the leveraged weight compounding system 10.

The cell tube 12 preferably approximates twenty-eight inches in length; however, the cell tube 12 may be any preferred length between twelve and thirty-two inches at the discretion of an individual or manufacturer.

The cell tube 12 functions to confine the plurality of weighted spheres 14 and the fluid-buffering means 16 between the sealing means 18 which are engaged to the interior surface of the cell tube 12 proximal to each end. The cell tube 12 functions to provide for the free flow and displacement of the fluid-buffering means 16, and the free rotational and linear movement of the plurality of weighted spheres 14, during use of the leveraged weight compounding system device 10. The minimization of imperfections to the interior surface of the cell tube 12 promotes and facilitates the free and uninhibited linear movement of the spheres 14 during use of the leveraged weight compounding system device 10.

A plurality of weighted spheres 14 are located within the interior of the cell tube 12. Each sphere 14 preferably has a second outside diameter dimension approximating 1.500±0.003 inches. It should be noted that the plurality of weighted spheres 14 are preferably of equal size, having a second diameter dimension less than the first or inside diameter dimension of the cell tube 12 which is 1,625±0.025 inches. Each of the plurality of weighted spheres 14 preferably has a spherical volume approximating 1.7671 cubic inches.

The approximate mass weight for a sphere 14 having a second or outside diameter approximating 1.500 inches is 0.500 pounds. The roundness specification for a sphere 14 is preferably equal to "0" within±0.003 for a total indicator reading. The spheres 14 are preferably formed of a chrome, steel-alloy metal material as identified as No. 52,100 as supplied by Royal Steel Ball Products, Inc. of Sterling, Ill. 61081 or an approved equivalent thereof. The spheres 14 may be formed of any dense metal, ceramic, and/or plastic material at the preference of an individual or manufacturer provided that the essential functions, features, and attributes described herein are not sacrificed. The mass weights for the spheres 14 have been provided for illustrative purposes only. Each of the spheres 14 should have a preselected and equal mass in order to provide to an individual a range of required exertion or load during use of leveraged weight compounding system device 10.

The spheres 14 are preferably heat treated to the Rockwell "C" scale hardness of 60 minimum. Each of the spheres 14 preferably has a surface finish approximating 8/15 micro inches. The spheres 14 preferably meet the American National Standard (AFBMA) Grade 1,000 metal ball rating. The Grade 1,000 rating for the spheres 14 incorporates the preferred attributes to accomplish smooth constant linear transition of mass within the cell tube 12, which in turn produces the leveraged weight compounding component at a horizontal deviation of approximately 5° minimum. The attributes of linear mass transition at minimum angular deviation facilitates the maximum duration of static exercises by a user. The grade 1,000 metal ball rating for the spheres 14 preferably satisfies the mechanical as well as cosmetic attributes of the leveraged weight compounding system 10.

The interior of the cell tube 12 holds between two and six spheres 14 at the preference of an individual or manufacturer where the multiple of sphere diameters preferably does not exceed 40% of the cell tube 12 internal capacity. The reduction in size of the second diameter of the spheres 14, with respect to the first diameter of the cell tube 12, provides for the free and uninhibited rotational and linear movement of the spheres 14 within the interior of the leveraged weight compounding system device 10. The absence of imperfections found on the interior surface of the cell tube 12 promotes free uninhibited linear movement of the spheres 14. The roundness specifications and surface finish of the spheres 14 promote a smooth transition of rotation and linear motion of the spheres 14 with respect to each other and with respect to the cell tube 12. The plurality of weighted spheres 14 produce immediate linear movement within the cell tube 12 upon the elevation or descent of an end of the leveraged weight compounding system device 10. The position of the mass of the spheres 14 within the cell tube 12 is then freely transferred as a portion of the leveraged weight compounding system device 10 during exercise and physical therapy activities. An individual using the leveraged weight compounding system device 10 is then exposed to a moving mass which continuously varies the force or level of muscle activity required during exercise. The linear movement of the mass results from the motion of the spheres 14 within the cell tube 12.

A fluid-buffering means 16 is disposed within the interior of the cell tube 12. The fluid-buffering means 16 functions to provide resistance to the movement of the plurality of spheres 14 during use of the leveraged weight compounding system device 10.

The fluid-buffering means 16 is preferably a Federal Drug Administration approved specific gravity sensitive liquid. The fluid-buffering means 16 preferably has a clear appearance. The fluid-buffering means 16 may be of any color as preferred by a manufacturer. The fluid-buffering means 16 significantly reduces the transitional speed and/or the speed of linear motion of the plurality of spheres 14 within the cell tube 12. The fluid-buffering means 16 is required to flow past the circumference of the spheres 14 during use of the leveraged weight compounding system device 10 which, in turn, slows the movement of the spheres 14 within the cell tube 12. The fluid-buffering means 16 in conjunction with the spheres 14 promotes the feeling of a fluid mass visually, and to the touch, of an individual. The fluid-buffering means 16 preferably slows the transition of the spheres 14 within the cell tube 12, where the transition of a twenty-eight inch cell extends for a durational period approximating three seconds to twelve seconds dependent upon the fluid-buffering means 16 selected, when the end of the variable leveraged weight compounding system device 10, confining the spheres 14, is elevated from a horizontal to a vertical position. The fluid-buffering means 16 significantly increases the duration for the transition of the spheres 14, from one end of the cell tube 12 to the other, during the establishment of an inclined plane. The duration for the exposure of exercise to an individual is thereby significantly increased, improving the utility of the leveraged weight compounding system device 10.

The fluid-buffering means 16 is preferably filtered prior to its disposition within the cell tube 12. A 0.5 sized micron filter is preferably used to filter particles and/or imperfections from the fluid-buffering means 16 having a size of 0.5 microns or larger. A bacteria suppressing agent may be preferably added to the fluid-buffering means 16 prior to the finalization of assembly of the leveraged weight compounding system device 10. The anti-bacterial agent increases the useful life of the fluid-buffering means 16 thereby increasing the useful life of the variable leveraged weight compounding system device 10. The fluid-buffering means 16 preferably has a specific gravity of approximating 0.96, a flash point of 300° F. to 605° F., a viscosity of 233 sus.; the fluid-buffering means is also non-corrosive, and has a hazardous material identification system rating (HMIS) of health (0), flammability (1), and reactivity (0). The fluid-buffering means 16 is preferably a silicon base dimethyl, siloxane polymer as manufactured by Dow Corning of Midland, Mich. 48640 or an approved equivalent thereof. Alternatively, the fluid-buffering means 16 may be an Federal Drug Administration approved petrochemical or mineral based oil.

The sealing means 18 confine the plurality of weighted spheres 14 and the fluid-buffering means 16 within the interior of the cell tube 12. In general, the sealing means 18 includes a pressure bushing 24, an outer seal washer 26, a stud plate 28, and a cap pivot 30. The sealing means 18 may alternatively include the use of nuts, bolts, and/or washers, as preferred by an individual provided the sealing means 18 prevents leakage, seepage, and/or loss of the fluid-buffering means 16 from the interior of the cell tube 12. It should also be noted that the sealing means 18 is generally required to establish a tight seal preventing seepage, leakage, or loss of the fluid-buffering means 16 from the interior of the cell tube 12, while simultaneously not fracturing, cracking, splitting and/or breaking the cell tube 12. An additional example of an alternative sealing means 18 may include a threaded cap for affixation to the exterior of the ends of the cell tube 12.

A cylindrical pressure bushing 24 is preferably positioned within the interior of each of the ends of the cell tube 12. Each cylindrical pressure bushing 24 is preferably extruded or molded of buna-nitrile material having a shore "A" hardness rating approximately equal to 60±5 durometer. Alternatively, each cylindrical pressure bushing 24 may be molded of neoprene or urethane material having a shore "A" hardness rating approximating 65±5 durometer. Each pressure bushing 24 is preferably formed of Federal Drug Administration listed ingredients. Each pressure bushing 24 is preferably black; however, each pressure bushing 24 may be molded of any color of material at the preference of the individual or manufacturer. Each cylindrical pressure bushing 24 preferably satisfies the ASTM D-2000 test and has a tensile strength approximately of 1,450 pounds per square inch.

Figure 2:
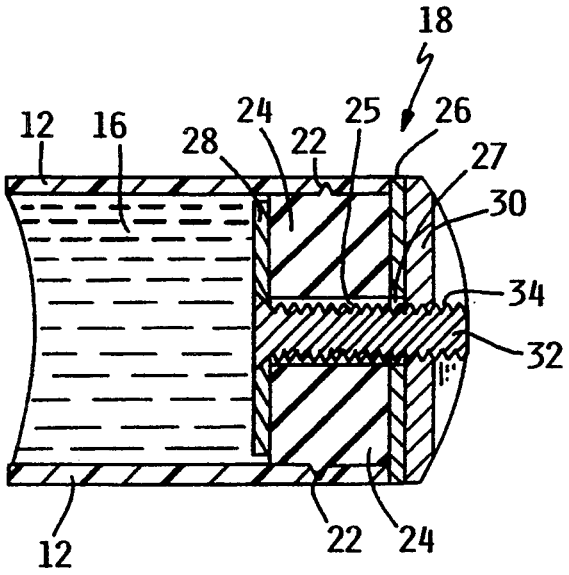
FIG. 2 is a detailed cross-sectional view of the invention take along line 2—2 of FIG. 1.

Each pressure bushing 24 preferably has a third outside diameter dimension of approximately 1.56±0.010 inches and a length of approximately 0.88 inches. Each pressure bushing 24 preferably has a centrally positioned first aperture 25 therethrough having a diameter dimension of approximately 0.312±0.010 inches. It should be noted that the dimension of the third outside diameter for each of the pressure bushings 24 is preferably smaller than the dimension of the first diameter of the cell tube 12 for internal engagement therewith. It should also be noted that each of the pressure bushings 24 may be centrally positioned with respect to the interior channels 22 of each of the ends of the cell tube 12. If the cell tube 12 contains interior channels 22, then the interior channels 22 are positioned equal distances from the edges of the corresponding pressure bushing 24. (FIG. 2)

A cylindrical pressure bushing 24 having the attributes and features described herein may be obtained from the Atlantic India Rubber Company of Goshen, Ind. 46526 or an approved equivalent thereof.

The pressure bushings 24 expand for flush sealing engagement to the interior of each of the ends of the cell tube 12 thereby preventing the leakage, seepage, splitting and/or loss of the fluid-buffering means 16 during use of the leveraged weight compounding system device 10. The pressure bushings 24 also function to define the area of linear movement for the spheres 14 within the cell tube 12.

An outer seal washer 26 is preferably positioned in covering relation over each of the ends of cell tube 12. The interface between the edge of the cell tube 12 and the outer seal washers 26 is preferably perpendicular to the axis of the cell tube 12.

Each of the outer seal washers 26 is preferably stamped of steel metal material coated with black zinc. Each outer seal washer 26 preferably has an outside fourth diameter dimension approximating 1.730±0.010 inches. It should be noted that the fourth diameter dimension of each outer seal washer 26 is equal to the exterior diameter of the cell tube 12. Each outer seal washer 26 preferably has a centrally positioned second aperture 27 therethrough having a diameter dimension approximating 0.343±0.010 inches.

The second aperture 27 for each of the outer seal washers 26 is preferably aligned with the first apertures 25 of the pressure bushings 24 during assembly of the leveraged weight compounding system device 10. The purpose of the outer seal washers 26 is to function as a plate separating the pressure bushings 24 from the cap pivots 50. When the sealing means 18 is tightened, the outer seal washers 26 prevent elongation of the pressure bushings 24, resulting in the expansion of the third diameter for flush engagement to the interior walls of the cell tube 12 proximal to each end of the leveraged weight compounding system device 10.

The outer seal washers 26 may be stamped of any preferred metal and/or rigid plastic material at the preference of an individual or manufacturer provided that the essential functions, features, and attributes described herein are not sacrificed.

A stud plate 28 is preferably engaged to each pressure bushing 24 within the interior of the cell tube 12. Each stud plate 28 includes a threaded post 32 which extends perpendicularly outward therefrom. The threaded posts 32 are preferably centrally positioned with respect to the snug plates 28 for penetrating engagement through the first apertures 25 of the pressure bushing 24 and the second apertures 27 of the outer seal washers 26.

Each stud plate 28 is generally circular in shape having a fifth diameter dimension approximating 1.437±0.010 inches. It should be noted that the fifth diameter of the stud plates 28 is preferably 0.05 to 0.09 inches smaller than the diameter for the pressure bushings 24. The reduced size of the fifth diameter of the stud plates 28, with respect to the third diameter of the pressure bushings 24, permits the pressure bushings 24 to be longitudinally compressed which results in the expansion of the third diameter for engagement to the interior walls of the cell tube 12.

Each stud plate 28 is preferably stamped of one-piece steel metal material coated with black zinc. Each stud plate 28 is preferably of sufficient strength and durability to not fracture, distort, and/or fail upon exposure of the stud plate screw to 200 inch pounds of torque or 850 pounds per square inch of push-out force. The length for each of the threaded posts 32 is at least 1.25 inches. The major thread diameter dimension for each of the threaded posts 32 is approximately 0.312 nominal American Standards Association 5/16–18 United National Course threaded standards.

Each stud plate 28 may be stamped of any sturdy metal and/or plastic material at the preference of an individual or manufacturer provided the essential functions, features, and attributes described herein are not sacrificed.

Each stud plate 28 functions as the base for flush engagement to a pressure bushing 24 within the interior of the cell tube 12. During tightening of the sealing means 18, the reduced size of the fifth diameter with respect to the third diameter of the pressure bushings 24, enhance the expansion of the third diameter for flush and continuous engagement to the interior of the cell tube 12.

Each threaded post 32 functions as the primary tightening member for the sealing means 18. Each threaded post 32, which passes through a first aperture 25 of a pressure bushing 24 and the second aperture 27 of an outer seal washer 26, upon tightening of the sealing means 18, squeezes/compacts a pressure bushing 24 between the stud plate 28 and the outer seal washer 26 expanding the pressure bushing 24.

A cap pivot 30 is preferably engaged to the exterior of each outer seal washer 26 at each end of the cell tube 12. Each cap pivot 30 is also preferably engaged to a threaded post 32 of each stud plate 28 completely defining the engagement of the sealing means 18 to the cell tube 12. Each cap pivot 30 is preferably of one-piece construction machined of steel metal material coated with black zinc.

Each cap pivot 30 is preferably circular in shape and includes a domed exterior having a centrally positioned groove or slot. Each cap pivot 30 has a sixth diameter dimension approximating 1.73±0.01 inches which is preferably equal to the fourth diameter of an outer seal washer 26. It should be noted that the dimensions provided for the cap pivots 30 may be suitably reduced for engagement to a cell tube 12, pressure bushing 24, outer seal washers 26, and stud plate 28 for use with a leveraged weight compounding system device 10 of smaller diameter. Each cap pivot 30 includes a lip portion engaged to an outer seal washer 26. The lip portion has a thickness dimension approximating 0.04±0.02 inches. The domed exterior for each of the cap pivots 30 has a radius of 1.62 inches which establishes an overall thickness dimension for a cap pivot 30 of approximately 0.38±0.03 inches. The slot or groove through the domed exterior of a cap pivot 30 has a width approximating 0.09+0.010 and −0.020 inches.

Each cap pivot 30 includes a centrally positioned 5/16–18 UNC threaded third aperture 34 which is preferably sized for receiving engagement of a 5/16–18 UNC threaded post 32 of a stud plate 28. Each cap pivot 30 is preferably of sufficient strength and durability to not fracture, bend and/or fail following engagement to a threaded post 32 of a stud plate 28. Each cap pivot 30 may be formed of any sturdy metal and/or plastic material at the preference of an individual or manufacturer provided the essential functions, features and attributes described herein are not sacrificed.

The purpose of the cap pivots 30 is to engage the stud plates 28 for contraction of the pressure bushings 24 within the interior of the cell tube 12. During tightening of the sealing means 18, the third apertures 34 of the cap pivots 30 engage the threaded posts 32 of the stud plates 28. The rotation of the cap pivots 30, via the grooves or slots 36 tightens the cap pivots 30 with respect to the stud plates 28 longitudinally compressing the pressure bushings 24. Continued tightening of the sealing means 18 may then cause a portion of the pressure bushings 24 to extrude into the interior channels 22, if used, of the cell tube 12. A mechanical and friction seal between the pressure bushings 24 and the interior of the cell tube 12 is thereby established, preventing seepage, leakage, and/or loss of fluid-buffering means 16. It should be noted that tightening of the sealing means 18 does not occur to an extent such that the expansion of a pressure bushing 24 causes the cell tube 12 to crack, split, or fracture. It should also be noted that tightening of the sealing means 18 does not occur to an extent such that an outer seal washer 26 fractures, splits, or cracks either end of the cell tube 12.

At least one tubular grip 38 is affixed to the exterior of the cell tube 12. A tubular grip 38 may be centrally positioned at the zero point of balance for the leveraged weight compounding system device 10 or may be positioned proximal to one or both of the ends of the cell tube 12. Alternatively, a tubular grip 38 may extend over the entire exterior surface of the cell tube 12. A tubular grip 38 may be positioned at any location upon the exterior of the cell tube 12 preferred by an individual.

Each tubular grip 38 is preferably manufactured of an extruded foam process and secondarily ground to remove skin to reveal a porous non-slip surface with radius edges having a pre-expansion diameter dimension of approximately 1.37 inches. The tubular grips 38 are applied to the exterior of the cell tube 12 by prewetting of the interior with a soap lubricant and then sliding the tubular grips 38 over the exterior of the cell tube 12 to a preferred location. A tight friction engagement is then established where the tubular grip 38 does not slide along the exterior surface of the cell tube 12 during use of the leveraged weight compounding system device 10. The tubular grip 38 preferably has an approximate density of 12+2, −1 pounds per cubic foot, a length of approximately 6.125 inches, and a minimum wall thickness of approximately 0.125 inches and is preferably formed of a mixture of polyvinyl chloride and nitrile material.

Each tubular grip 38 may contain a plurality of spherical nubbins which act to massage the pressure points of an individual's hand during the use of the leveraged weight compounding system device 10. The comfort to an individual may then be significantly improved.

The purpose of a tubular grip 38 is to provide to an individual a non-slip comfortable grasping surface during use of the leveraged weight compounding system device 10. A tubular grip 38 preferably facilitates the firm, comfortable and non-slip use of the leveraged weight compounding system device 10 following exposure to moisture and/or perspiration. It should be noted that any preferred material such as foam grip and/or racquet tape may be applied to the exterior of the cell tube 12 to provide a non-slip grasping surface for an individual.

During use of the leveraged weight compounding system device 10, the features of the invention operate pursuant to the combined physical theories of an inclined plane and levers incorporating the use of a fulcrum, load, and effort to be exerted by an individual during exercise. Initially, upon the elevation or descent of one of the ends of the cell tube 12, an inclined plane is established. This causes the plurality of weighted spheres 14 to rotate and move linearly within the cell tube 12 toward the end having the reduced elevation. The load or mass for the variable leveraged weight compounding system device 10 is therefore placed in motion by an individual. The fluid-buffering means 16 provides internal resistance to the linear movement of the weighted spheres 14 increasing the duration of movement within the cell tube 12. The fulcrum is established by the position of the individual's hand upon the exterior of the cell tube 12. The position of the individual's hand requires the individual to incorporate a varied and compounding effort during exercise, physical therapy, and/or use of the leveraged weight compounding system device 10. The adjustment of the position of the fulcrum, or the individual's hand, varies the leveraged exertion required by an individual during exercise. If an individual grasps the invention proximal to the weighted spheres, substantially less exertion and effort is required during exercise as compared to grasping the invention away from the weighted spheres. An individual may therefore avoid static exercise and elect to exercise muscles pursuant to a leveraged compounding system which increases the duration and enjoyment of physical therapy and/or exercise activities. It should be noted that an infinite variety and number of different types of exercise is available to an individual using the variable leveraged weight compounding system device 10. During operation, the leveraged weight compounding system device 10 provides to a user a visually soothing and relaxing exercise device simultaneous to the rendition of beneficial effects for the rehabilitation or toning of muscles. A user of the leveraged weight compounding system device 10 may be visually stimulated and relaxed by the observation of the gradual movement of the chrome spheres 14, and any air bubbles, within the clear to amber colored fluid-buffering means 16. The aesthetics of the leveraged weight compounding system device 10 communicates a very peaceful or tranquil feeling to a user, thereby significantly reducing the perceived duration of exercise. An individual may then use the leveraged weight compounding system device 10 for longer periods of time which may reduce the duration of required physical therapy or reduce the duration of improvement to muscle tone. Additionally, the soothing aesthetic effects of the gradual movement of the spheres 14 and/or air bubbles within the clear to amber colored fluid-buffering means 16, may distract an individual's attention from discomfort or pain experienced during physical therapy activities. The leveraged weight compounding system device 10 thereby significantly improves the enjoyment of the use of the device to a user.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A leveraged weight compounding system device comprising:

(a) a cell tube having a first diameter, and a length;

(b) a plurality of weighted spheres disposed inside the cell tube each of said weighted spheres having a diameter approximately equal to, but smaller than, said first diameter, said weighted spheres having rotational and linear movement along said entire length of said cell tube, said weighted spheres providing for the linear-transition of a confined mass within said cell tube;

(c) a fluid-buffering means completely filling said cell tube, said fluid-buffering means for providing resistance to movement of said plurality of weighted spheres, said fluid buffering means slowing said linear-transition of confined mass within said cell tube; and (d) a means for sealing said cell tube confining said plurality of weighted spheres and said fluid-buffering means inside said cell tube whereby the duration of said linear-transition of confined mass within said cell tube is increased.

2. The leveraged weight compounding system device according to claim 1 further comprising a grip affixed to said cell tube for grasping by a human hand.

3. The leveraged weight compounding system device according to claim 2, wherein said grip further comprises a non-slip surface.

4. The leveraged weight compounding system device according to claim 1, wherein said cell tube is formed of an extruded polycarbonate material.

5. The leveraged weight compounding system device according to claim 1, wherein each of said spheres has an approximate mass weight between one quarter and one-half pound.

6. The leveraged weight compounding system device according to claim 1, wherein said fluid-buffering means is a liquid mineral oil.

7. The leveraged weight compounding system device according to claim 1, wherein said cell tube further comprises an interior, an exterior, and two ends.

8. The leveraged weight compounding system device according to claim 7, wherein said sealing means further comprises:

(a) a cylindrical pressure bushing having a second diameter engaged to said interior of each end of said cell tube, each of said pressure bushings having a central first aperture therethrough;

(b) an outer seal washer engaged to each of said pressure bushings exterior to said cell tube, each of said outer seal washers having a central second aperture therethrough aligned to said first apertures;

(c) a stud plate engaged to each of said pressure bushings within said interior of said cell tube, each of said stud plates having a threaded post passing through said first apertures and said second apertures; and (d) a cap pivot engaged to each of said outer seal washers exterior to said cell tube, each of said cap pivots having a centrally positioned threaded third aperture for engagement to said threaded posts, each of said cap pivots further having a groove positioned opposite to said third aperture, said groove for tightening said cap pivots to said stud plates expanding said pressure bushings against said interior of said cell tube.

9. The leveraged weight compounding system device according to claim 8, wherein said cell tube further comprises a channel encircling said interior of said ends of said cell tube, said channels positioned proximal to said pressure bushings, said channels for receiving engagement of a portion of said pressure bushings upon tightening of said cap pivots to said stud plates.

10. The leveraged weight compounding system device according to claim 8, wherein said outer seal washers cover said ends of said cell tube.

11. The leveraged weight compounding system device according to claim 10, wherein said cap pivots cover said outer seal washers.

12. The leveraged weight compounding system device according to claim 11, wherein each of said stud plates has a third diameter of smaller dimensional size than said first diameter of said cell tube and of smaller dimensional size than said second diameter of said pressure bushings.

13. The leveraged weight compounding system device according to claim 8, wherein each of said cap pivots has a domed exterior opposite to said outer seal washers.

14. The leveraged weight compounding system device according to claim 7, wherein said plurality of spheres are of equal size.

15. A leveraged weight compounding system device comprising:

(a) a cell tube having a first diameter, an interior, an exterior, a length, and two ends;

(b) a plurality of weighted spheres disposed inside said cell tube, said plurality of spheres having a second diameter approximately equal to, but smaller than said first diameter of said cell tube, said weighted spheres having rotational and linear movement along said entire length of said cell tube, said weighted spheres providing for linear-transition of a confined mass within said cell tube;

(c) a fluid-buffering means completely filling said cell tube, said fluid-buffering means for providing resistance to movement of said plurality of weighted spheres, said fluid-buffering means slowing said linear-transition of said confined mass within said cell tube;

(d) a means for sealing said cell tube confining said plurality of weighted spheres and said fluid-buffering means within said interior of said cell tube whereby the duration of said linear-transition of said confined mass within said cell tube is increased, said sealing means comprising:

(i) a pressure bushing engaged to each end of said cell tube;

(ii) an outer seal washer engaged to each of said pressure bushings exterior to said cell tube;

(iii) a stud plate engaged to each of said pressure bushings within said interior of said cell tube, each of said stud plates having a post for passing engagement through said pressure bushings and said outer seal washers; and (iv) a cap pivot engaged to each of said outer seal washers, each cap pivot further engaged to one of said posts of said stud plates; and (e) at least one tubular grip affixed to said exterior of said cell tube for grasping by a human hand.

16. A leveraged weight compounding system device comprising:

(a) a cylindrical-shaped cell tube having a first diameter, an interior, an exterior, an internal capacity, a length, and two ends;

(b) a plurality of weighted spheres of equal size disposed inside said cell tube, said plurality of weighted spheres having a second diameter approximately equal to but smaller than said first diameter of said cell tube each of said weighted spheres having an approximate mass weight between one-quarter and one-half pound, said weighted spheres not exceeding 40% of said internal capacity of said cell tube, said weighted spheres having rotational and linear movement along said entire length of said cell tube, said weighted spheres providing for the linear-transition of a confined mass within said cell tube;

(c) a fluid-buffering means comprised of mineral oil completely filling said cell tube, said fluid-buffering means for providing resistance to movement of said plurality of weighted spheres, said fluid-buffering means slowing said linear-transition of said confined mass within said cell tube;

(d) a means for sealing said cell tube confining said plurality of weighted spheres and said fluid-buffering means within said interior of said cell tube whereby the duration of said linear-transition of said confined mass within said cell tube is increased, said sealing means comprising:

(i) a cylindrical pressure bushing having a third diameter smaller than the said first diameter of said cell tube engaged to said interior of each end of said cell tube, each of said pressure bushings having a central first aperture therethrough;

(ii) an outer seal washer engaged to each of said pressure bushings exterior to said cell tube, each of said outer seal washers having a central second aperture therethrough aligned to said first apertures, each of said outer seal washers covering said ends of said cell tube;

(iii) a stud plate engaged to each of said pressure bushings within said interior of said cell tube, each of said stud plates having a threaded post for passing engagement through said first apertures and said second apertures, each of said stud plates having a fourth diameter smaller than said third diameter; and (iv) a cap pivot having a domed exterior covering and engaged to each of said outer seal washers exterior to said cell tube, each of said cap pivots having a centrally positioned threaded third aperture for receiving engagement of said threaded posts, each cap pivot further having a groove through said domed exterior positioned opposite to said third aperture, said groove for tightening said cap pivots to said stud plates expanding said pressure bushings against said interior of said cell tube; and (e) at least one tubular grip affixed to said exterior of said cell tube for grasping by a human hand.

* * * * *